US009827577B2

(12) United States Patent
Kuwahara

(10) Patent No.: US 9,827,577 B2
(45) Date of Patent: Nov. 28, 2017

(54) EJECTION HEAD AND CONTAINER PROVIDED WITH THE SAME

(71) Applicant: Katsuhito Kuwahara, Tokyo (JP)

(72) Inventor: Katsuhito Kuwahara, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 75 days.

(21) Appl. No.: 14/438,453

(22) PCT Filed: Dec. 13, 2012

(86) PCT No.: PCT/JP2012/007980
§ 371 (c)(1),
(2) Date: Apr. 24, 2015

(87) PCT Pub. No.: WO2014/068627
PCT Pub. Date: May 8, 2014

(65) Prior Publication Data

US 2015/0273486 A1 Oct. 1, 2015

(30) Foreign Application Priority Data

Oct. 31, 2012 (JP) ..... 2012-241258

(51) Int. Cl.
*B05B 1/02* (2006.01)
*B05B 1/34* (2006.01)
(Continued)

(52) U.S. Cl.
CPC ..... *B05B 1/02* (2013.01); *B05B 1/00* (2013.01); *B05B 1/3436* (2013.01);
(Continued)

(58) Field of Classification Search
CPC ..... B05B 1/3436; B05B 1/02; B05B 1/00; B65D 83/20
(Continued)

(56) References Cited

U.S. PATENT DOCUMENTS 3,897,006 A * 7/1975 Tada ..... B05B 11/3074 222/321.8
3,973,700 A * 8/1976 Schmidt ..... B05B 11/303 222/153.13
(Continued)

FOREIGN PATENT DOCUMENTS

AU 2011-266100 B2 4/2015
DE 19918120 A1 10/2000
(Continued)

OTHER PUBLICATIONS

Apr. 6, 2016 Office Action issued in Chinese Patent Application No. 201280076672.X.
(Continued)

*Primary Examiner* — Chee-Chong Lee
(74) *Attorney, Agent, or Firm* — Oliff PLC

(57) ABSTRACT

The ejection head includes a pressing member; a nozzle tip that is fitted to a concavity; and an insert member. The insert member includes: a concave portion that forms a filling space for the content medium; at least one through hole formed on a circumferential wall; and a long groove that extends from the through hole to the nozzle tip. The insert member has a front end having an outer circumferential edge formed as an annular inclined surface, and the front end is formed with a bulging portion. The bulging portion is formed with a plurality of radial grooves and a cylindrical groove. At least one through hole is located in a position that is circumferentially offset from the plurality of radial grooves.

6 Claims, 13 Drawing Sheets

(51) Int. Cl.
*B05B 11/00* (2006.01)
*B05B 1/00* (2006.01)

(52) U.S. Cl.
CPC ..... *B05B 11/0016* (2013.01); *B05B 11/0032* (2013.01); *B05B 11/3016* (2013.01); *B05B 11/3047* (2013.01); *B05B 11/3063* (2013.01)

(58) Field of Classification Search
USPC ..... 239/490; 222/564, 547
See application file for complete search history.

(56) References Cited

U.S. PATENT DOCUMENTS 3,995,774 A * 12/1976 Cooprider ..... B05B 11/303 222/207
4,168,788 A * 9/1979 Quinn ..... B05B 11/0018 222/383.1
4,199,083 A * 4/1980 LoMaglio ..... B05B 11/303 222/207
4,204,614 A * 5/1980 Reeve ..... B05B 1/12 215/209
4,225,061 A * 9/1980 Blake ..... B05B 11/3032 222/207
4,260,079 A * 4/1981 Cary ..... B05B 11/3035 222/209
4,273,290 A * 6/1981 Quinn ..... B05B 1/3436 239/333
4,583,692 A 4/1986 Sheffler et al.
5,303,867 A * 4/1994 Peterson ..... B05B 1/3436 222/207
5,526,985 A 6/1996 Martin
5,992,765 A * 11/1999 Smith ..... B05B 1/3436 239/337
6,938,803 B2 9/2005 Shimada et al.
7,886,995 B2 * 2/2011 Togashi ..... B05B 1/341 222/321.8

FOREIGN PATENT DOCUMENTS

GB 2154473 A 9/1985
JP S60-202761 A 10/1985
JP S61-132064 U 8/1986
JP 2011-147920 A 8/2011
JP 2011-177627 A 9/2011

OTHER PUBLICATIONS

Dec. 9, 2015 Office Action issued in Australian Patent Application No. 2012393894.
Jul. 9, 2013 International Search Report issued in International Patent Application No. PCT/JP2012/007980.
Jan. 9, 2017 Office Action issued in Chinese Patent Application No. 201280076672X.

* cited by examiner

A-A section

B-B section

C-C section

D-D section

E-E section

Enlarged view of area X

Enlarged view of area Y

EJECTION HEAD AND CONTAINER PROVIDED WITH THE SAME

TECHNICAL FIELD

The present invention relates to an ejection head that includes an inner passage to which a stem is fixed and that ejects a content drawn from the stem to an outside by displacing the stem upward and downward.

BACKGROUND

The present inventor has already proposed a known ejection head including a pressing member that drives a pump located in a container and a nozzle tip that is embedded with an insert member and is fixed to the pressing member, wherein the content is ejected through an orifice provided in the nozzle tip (Refer to Patent Literature 1, for example).

CITATION LIST

Patent Literature

PTL 1: JP2011177627A

SUMMARY

However, the present inventor conducted further tests and studies and has realized that the proposed ejection head still has room for improvement.

An objective of the present invention is to provide an ejection head that is capable of producing stable ejection patterns.

One aspect of the present invention resides in an ejection head, including: a pressing member that is fitted to a stem standing from a mouth tubular portion of a container body and that is formed with an introduction path to which a content medium is introduced; a nozzle tip that is fitted to a concavity formed on a side surface of the pressing member and that is formed with an ejection orifice for the content medium pumped from the introduction path; and an insert member that is located inside the nozzle tip and that forms a communication path allowing the introduction path formed in the pressing member to communicate with the ejection orifice formed in the nozzle tip. The insert member includes: a concave portion having an opening formed in a rear end of the insert member that faces to the pressing member, thereby forming a filling space to be filled with the content medium introduced from the introduction path; at least one through hole formed on a circumferential wall constituting the concave portion; and a long groove that is formed on the circumferential wall and that extends from the at least one through hole to the nozzle tip. The insert member has a front end facing to the nozzle tip, the front end having an outer circumferential edge formed as an annular inclined surface tapered toward a front end thereof, and the front end being formed with a bulging portion that protrudes forward of the inclined surface, the bulging portion being formed with a plurality of radial grooves and a cylindrical groove where the plurality of radial grooves joins, and at least one of the at least one through hole is located in a position that is circumferentially offset from the plurality of radial grooves.

Although the at least one through hole may of course include a through hole having a constant diameter, the at least one through hole may include a slant hole having a diameter that is increased in a direction from an inside to an outside of the insert member. Furthermore, the at least one through hole may be a single through hole that is located in a position that is circumferentially offset from the plurality of radial grooves.

The introduction path may include an opening formed in any position, for example, in an upper position. In this case, the opening allows the introduction path to communicate with the filling space.

Moreover, according to the present invention, the concavity may be provided with a plurality of bumps that form a plurality of radial grooves and a cylindrical groove where the plurality of radial grooves joins. By bringing the insert member into abutment with the plurality of bumps, a guiding path allowing the introduction path to communicate with the communication path may be formed.

Another aspect of the present invention resides in a pump container including an ejection head. The pump container includes the ejection head and a container body including a pump having a stem to which the ejection head is fitted.

According to the present invention, the insert member is located inside the nozzle tip to form the communication path communicating with the ejection orifice, and the through hole, which is formed on the circumferential wall of the insert member, is located in the position that is circumferentially offset from the radial grooves, which is formed on the front end of the insert member. With the above configuration, the ejection patterns, which are defined by states, angles, or the like of spraying, are better stabilized compared with conventional ejection patterns.

DETAILED DESCRIPTION

One embodiment of a pump bottle container including a spray head of the present invention will be described in detail below with reference to the drawings.

Figure 1:
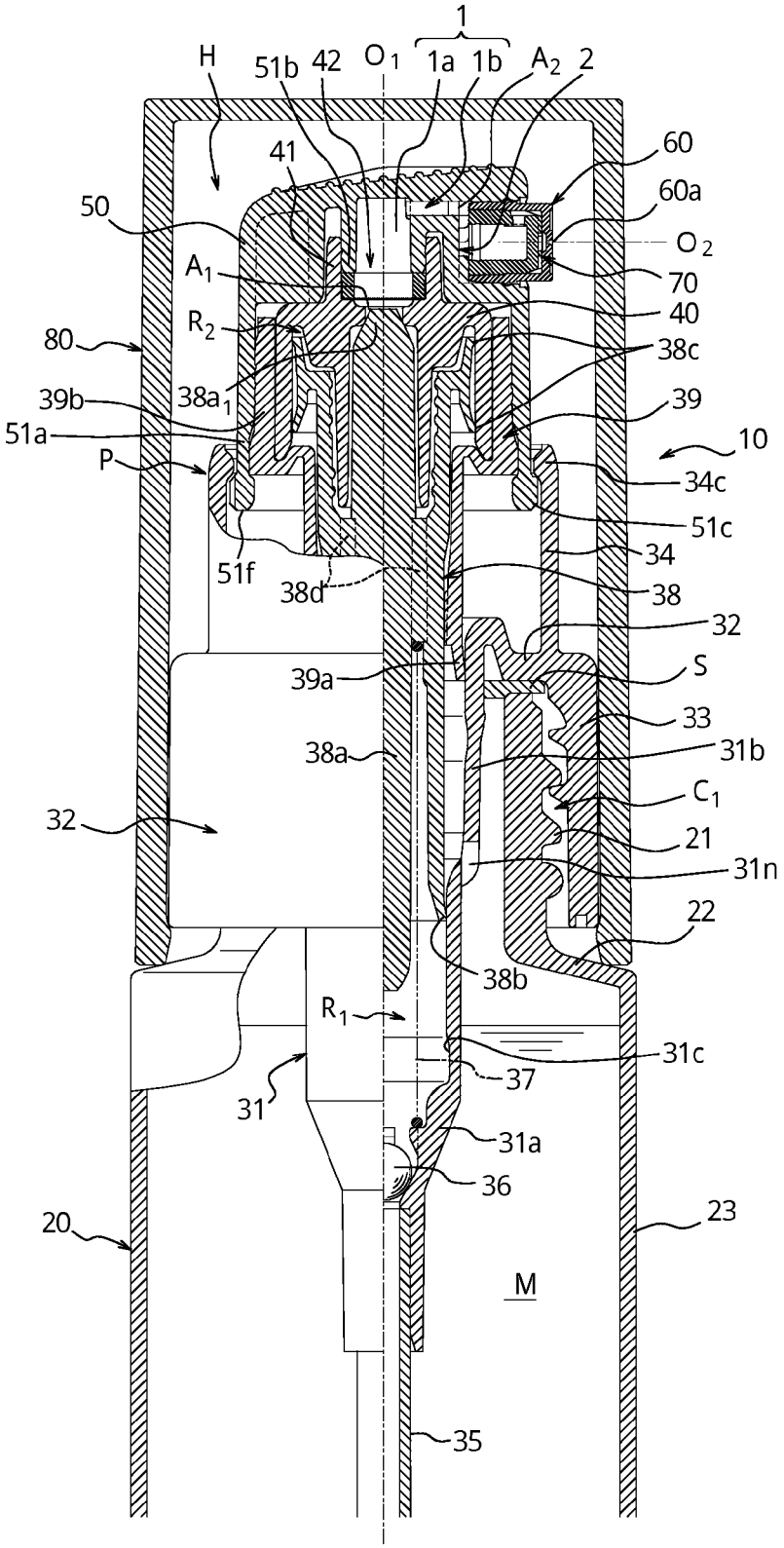
FIG. 1 is a side view taken along a partial section of a pump bottle container including a spray nozzle according to one embodiment of the present invention.

In FIG. 1, reference numeral 10 denotes the pump bottle container including a spray head H according to the one embodiment of the present invention. Reference numeral 20 denotes a container body. The container body 20 is a bottle-type container including a mouth tubular portion 21, a shoulder portion 22, and a trunk portion 23 connecting to the mouth tubular portion 21 via the shoulder portion 22. An inside of the container body 20 is filled with a content medium M.

To the container body 20, a pump unit P is fixed. The pump unit P includes a first cylinder 31 that is located inside the mouth tubular portion 21. The first cylinder 31 includes a small-diameter portion 31*a* and a large-diameter portion 31*b*, and an ambient air introduction hole 31*n* formed between the small-diameter portion 31*a* and the large-diameter portion 31*b*. The large-diameter portion 31*b* is provided with an upper end flange 32. With the upper end flange 32 being received and rest on an upper end of the mouth tubular portion 21, the first cylinder 31 is held inside the mouth tubular portion 21 in a hanging manner. The first cylinder 31 also includes a fitting tube 33 that is connected to the upper end flange 32. The fitting tube 33 is fixed to the mouth tubular portion 21 by a fixing means $C_1$. As illustrated in the figure, the fixing means may be a screw means. However, according to the present invention, the fixing means $C_1$ is not limited to the screw means. There is also provided an annular seal member S to seal between the mouth tubular portion 21 and the upper end flange 32. From the upper end flange 32, a guiding tube 34 also stands.

The small-diameter portion 31*a* of the first cylinder 31 is formed, on an inner side thereof, with an annular concave groove 31*c* extending circumferentially about a pump axis line (hereinafter, called "axis line") $O_1$. To the small-diameter portion 31*a*, an intake pipe 35, which communicates with the inside of the container body 20, is fixed. The content medium M drawn through the intake pipe 35 is introduced to an inside of the first cylinder 31 via a check valve 36. Inside the first cylinder 31, a pump plunger 38 is elastically supported via a spring 37.

The pump plunger 38 includes a plunger body 38*a*. The plunger body 38*a* includes a first piston 38*b* and a second piston 38*c*. The first piston 38*b* and the second piston 38*c* are integrally coupled via a plurality of ribs 38*d* that are located around the plunger body 38*a* at an interval. The first piston 38*b*, together with the small-diameter portion 31*a* of the first cylinder 31, forms a first pump chamber $R_1$. The first pump chamber $R_1$ has a pressure that is released when the first piston 38*b* reaches the annular concave groove 31*c*. An upper end opening of the first cylinder 31 is sealed by a lower end tube 39*a* included in a second cylinder 39. The lower end tube 39*a*, upon reaching the small-diameter portion 31*a* of the first cylinder 31, allows the ambient air introduction hole 31*n* to communicate with the outside. The second cylinder 39 also includes an upper end tube 39*b* formed with an opening, which is sealed by a cylinder cap 40. The cylinder cap 40, together with the upper end tube 39*b* of the second cylinder 39, defines space for accommodating the second piston 38*c*. Between the second piston 38*c* and the cylinder cap 40, a second pump chamber $R_2$ is also formed. The second pump chamber $R_2$ communicates with the first pump chamber $R_1$ through a gap formed between adjacent ribs 38*d* around the pump plunger 38. Furthermore, in the cylinder cap 40, an upper end opening $A_1$ is formed for allowing the first pump chamber $R_1$ and the second pump chamber $R_2$ to communicate with the outside. The upper end opening $A_1$ may be opened and closed by a tip portion $38a_1$ of the plunger body 38*a*. Accordingly, the tip portion $38a_1$ serves as a check valve (a discharge valve).

Figure 2:
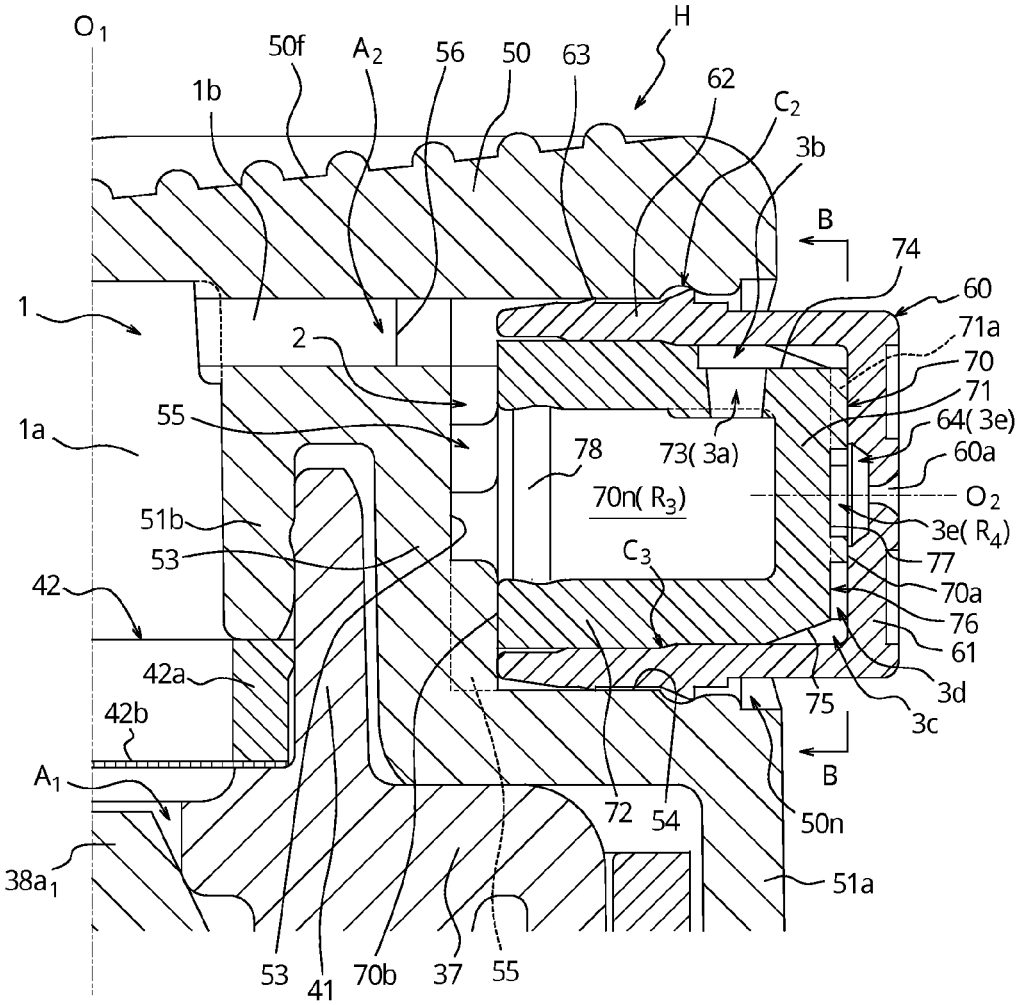
FIG. 2 is an enlarged sectional view of the spray nozzle according to the one embodiment.

Moreover, the cylinder cap 40 is provided with a stem 41 surrounding the upper end opening $A_1$. Inside the stem 41, a mesh ring 42 is disposed. As illustrated in FIG. 2, the mesh ring 42 is configured by a ring member 42*a* and a mesh member 42*b* adhered to one end of the ring member 42*a*. The mesh ring 42 may be disposed in plurality inside the stem 41. The mesh ring 42 may also be omitted.

Reference numeral H denotes the spray head constituting the pump unit P. The spray head H includes a pressing member 50 that is to be operated by a user. The pressing member 50 has a cylindrical shape in appearance, with an upper end thereof being formed as a pressing surface 50*f*. The pressed member 50 is also provided, in a lower end thereof, with an outer tubular portion 51*a* and an inner tubular portion 51*b* that are integrated. As illustrated in FIG. 1, the outer tubular portion 51*a* includes a slip-off preventing portion 51*c*. The slip-off preventing portion 51*c* slides over a slip-off preventing portion 34*c* formed in the guiding tube 34 to be fitted and then locked by the slip-off preventing portion 34*c*. Thus, the pressing member 50 is held by the guiding tube 34 in a manner such that the pressing member 50 is prevented from slipping off. The inner tubular portion 51*b* of the pressing member 50 is also fitted and held inside the stem 41. Furthermore, the pressing body 50 is formed, inside thereof, with an introduction path 1 into which the content medium M pumped through the mesh ring 42 is introduced. The introduction path 1 includes a vertical flow path 1*a*, which includes an opening on an inner side of a lower end of the inner tubular portion 51*b* and which extends along the axis line $O_1$, and a front-rear (horizontal) flow path 1*b*, which extends from the flow path 1*a* toward a side surface of the pressing member 50. As illustrated in FIG. 2, the front-rear flow path 1*b* communicates with a concavity 50*n* formed on the side surface of the pressing member 50.

Figure 3:
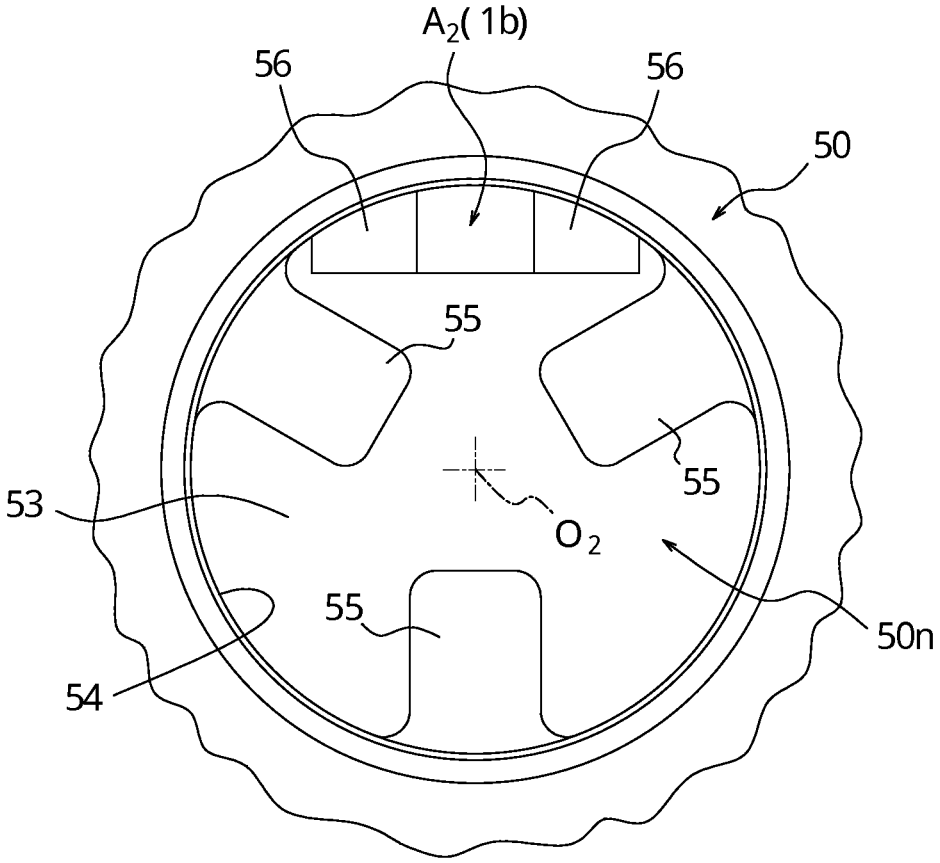
FIG. 3 is an enlarged front view of a concave portion formed on a side surface of a pressing member according to the one embodiment.

FIG. 3 is a front view of the concavity 50*n*. The concavity 50*n* is formed in a cylindrical shape. The concavity 50*n* includes a flat partition wall 53 that is integrally provided with a plurality of bumps 55. The bumps 55 each extend from an inner circumferential surface 54 of the concavity 50*n* toward a center $O_2$ of the concavity 50*n*. The front-rear flow path 1*b* has an opening $A_2$ formed in an upper position of the concavity 50*n* that is near the pressing surface 50*f*. On both sides of the opening $A_2$, stepped surfaces 56 connecting to the partition wall 53 are also formed.

Next, with reference to FIG. 2, reference numeral 60 denotes a nozzle tip that is fixed to the concavity 50*n*. The nozzle tip 60 includes a partition wall 61 that is provided with an ejection orifice 60*a*. The nozzle tip 60 also includes a circumferential wall 62 connected to the partition wall 61, thus forming a concavity inside the nozzle tip 60. The circumferential wall 62 of the nozzle tip 60 is fixed to the concavity 50*n*. In detail, the circumferential wall 62 of the nozzle tip 60 is fixed to the inner circumferential surface 54 of the concavity 50*n* by a fixing means $C_2$. As illustrated in the figure, the fixing means $C_2$ may be configured by an annular groove and an annular projection. The circumferential wall 62 is also provided with an annular sealing portion 63 that seals the inner circumferential surface 54 of the concavity 50*n*. The inner circumferential surface 54 of the concavity 50*n* is sealed by the nozzle tip 60. With the above configuration, the opening of the concavity 50*n* is tightly closed by the partition wall 61 of the nozzle tip.

Reference numeral 70 denotes an insert member that is located inside the nozzle tip 60 and that forms a communication path 3 that allows the introduction path 1 formed in the pressing member 50 to communicate with the ejection orifice 60*a*. As illustrated in FIG. 2, the insert member 70 includes a partition wall 71 that is fitted to an inner side of the partition wall 61 of the nozzle tip. The insert member 70 also includes a circumferential wall 72 connected to the partition wall 71, thus forming a concave portion 70*n* inside the insert member 70.

Figure 6:
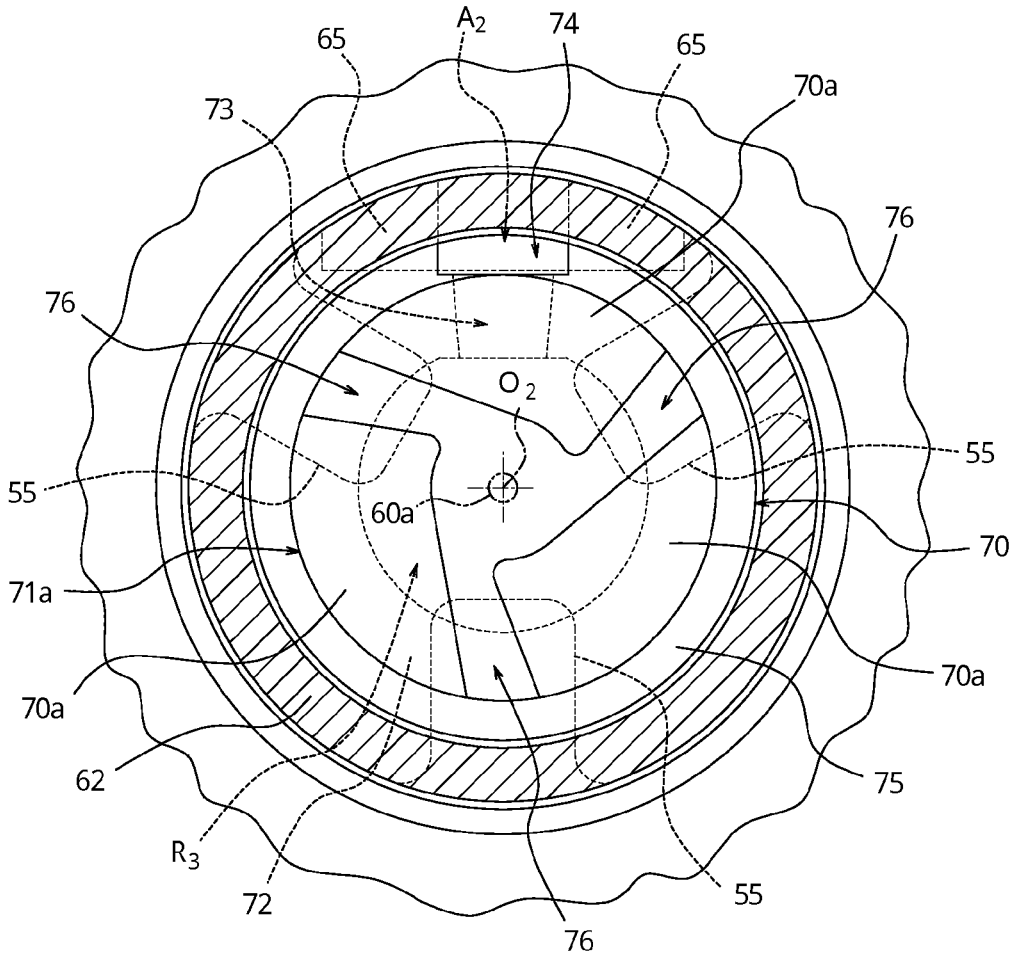
FIG. 6 is a sectional view taken along a line B-B in FIG. 2 that is partially virtual.

The concave portion 70*n* includes an opening formed in a rear end 70*b* of the concave portion 70*n* in a manner such that the opening and the partition wall 53 of the pressing member 50 face to each other. The rear end 70*b* is in contact with the three bumps 55 provided in the pressing member 50, thereby forming a gap oriented to the center $O_2$ under the guide of the bumps 55 between the rear end 70*b* and the partition wall 53 (refer to FIG. 7). Furthermore, as illustrated in FIG. 2, the circumferential wall 72 of the insert member 70 is fixed inside the circumferential wall 62 of the nozzle tip by a fixing means $C_3$. As illustrated in the figure, the fixing means $C_3$ may be implemented by press fitting for sealing an inner circumferential surface of the circumferential wall 62 of the nozzle tip by the circumferential wall 72 of the insert member. The concave portion 70*n* in the insert member 70, along with the nozzle tip 60, is fixed to the concavity 50*n* in the pressing member 50. By doing so, a guiding path 2, which allows the opening $A_2$ of the introduction path 1 to communicate with the concave portion 70*n*, is formed between the concave portion 70*n* and the partition wall 53. Accordingly, the concave portion 70*n* serves as a filling space $R_3$ to be filled with the content medium M introduced via the introduction path 2. In the present embodiment, an annular groove 78 is also formed on a portion of an inner circumferential surface of the circumferential wall 72 that is located close to the rear end 70*b* of the insert member. The annular groove 78 has a semicircular shape in its section. Furthermore, as illustrated in FIG. 6, the section of the filling space $R_3$ is in the form of a segment of a circle in which a portion of the circular appearance is replaced by a chord. However, according to the present invention, the section of the filling space $R_3$ may also be but not limited to any other shape such as a circular shape.

On the other hand, the circumferential wall 72 is formed with a single through hole 73 that allows the concave portion 70*n* to communicate with the outside. As illustrated in FIG. 2, the through hole 73 is a slant hole having a diameter that is increased in a direction from an inside to an outside of the insert member 70. According to the present invention, the through hole 73 may also have a constant diameter in the direction from the inside to the outside of the insert member 70. The circumferential wall 72 is also formed with a long groove 74 that extends from the through hole 73 to the nozzle tip 60. As described above, the circumferential wall 72 seals the inner circumferential surface of the circumferential wall 62 of the nozzle tip. Accordingly, the long groove 74 in the insert member forms the communication path 3 between the insert member and the circumferential wall 62 of the nozzle tip 60. The communication path 3 includes a first communication path 3*a*, which is configured by the through hole 73, and a second communication path 3*b*, which communicates with the filling space $R_3$ via the first communication path 3*a*.

The insert member 70 also has a front end 70*a* facing to the nozzle tip 60 that is formed as a flat surface. The front end 70*a* also has an outer circumferential edge that is formed as an annular inclined surface 75 tapered toward a front end thereof. Furthermore, the front end 70*a* is formed with a bulging portion 71*a* that protrudes forward of the inclined surface 75. With the above configuration, an annular third communication path 3*c* extending circumferentially about the center $O_2$ is formed between the inclined surface 75 and the nozzle tip 60. The third communication path 3*c* distributes the content medium M drawn from the second communication path 3*b* around the center $O_2$ (refer to FIG. 7).

Figure 4A:
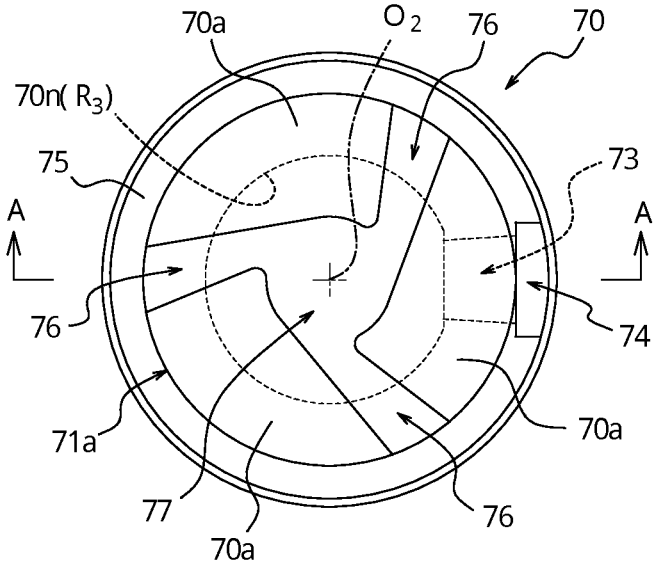
FIG. 4A is a front view of an insert member according to the one embodiment.
Figure 4B:
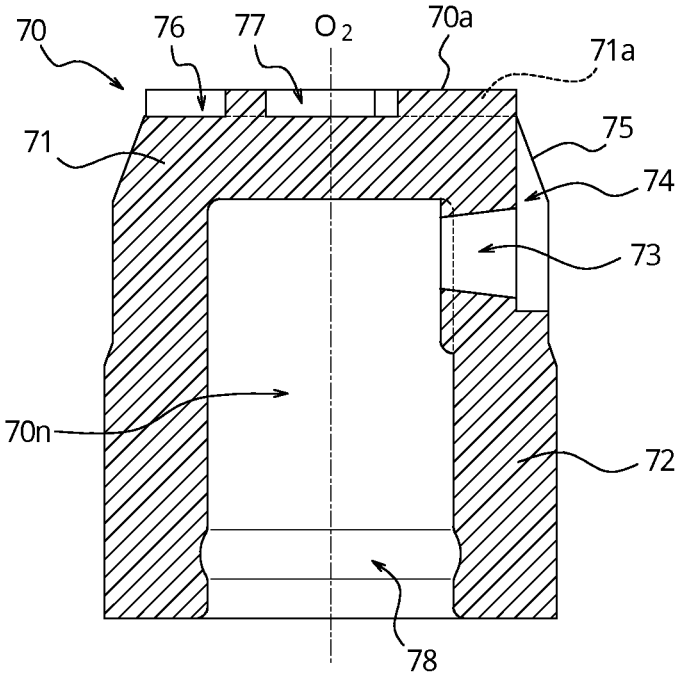
FIG. 4B is a sectional view taken along a line A-A in FIG. 4A.
Figure 5A:
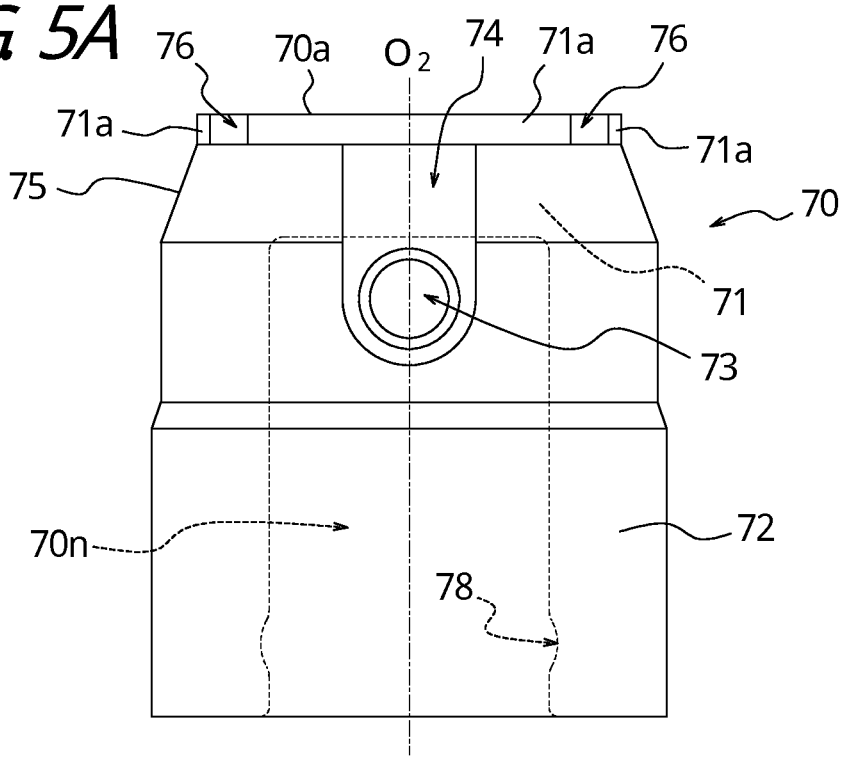
FIG. 5A is a side view of the insert member.
Figure 5B:
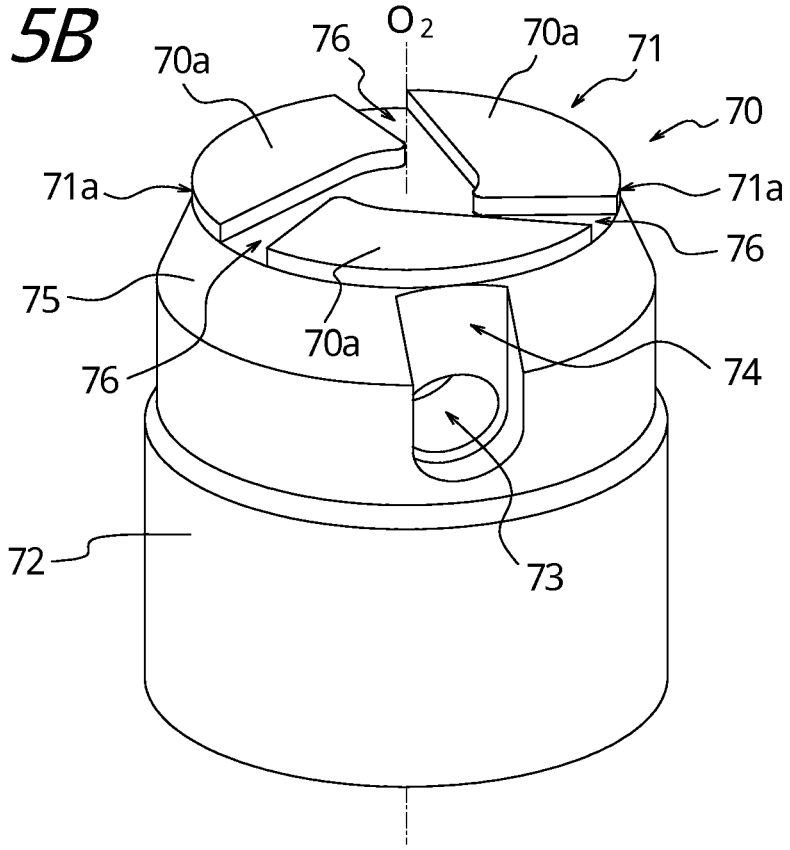
FIG. 5B is a perspective view of the insert member.

As illustrated in FIG. 4 (in particular, FIG. 4A), the bulging portion 71*a* is also formed with three radial grooves (spin grooves) 76 arranged at an interval about the center $O_2$ and formed, in the center $O_2$, with a cylindrical groove 77 where the radial grooves 76 join. In the present embodiment, as illustrated in FIG. 4A, the radial grooves 76 are each inclined to be tapered toward the cylindrical groove 77 about the center $O_2$. Furthermore, as illustrated in FIG. 5 (in particular, FIG. 5B), each radial groove 76 is formed in a position that is circumferentially offset from the long groove 74 (about the center $O_2$). Accordingly, the long groove 74 is arranged to bypass the radial groove 76 in the circumferential direction. However, according to the present invention, the radial groove 76 may also be formed in a position that is circumferentially aligned with the long groove 74. In this case, the long groove 74 may be in direct communication with the radial groove 76 without bypassing the radial groove 76 in the circumferential direction. As illustrated in FIG. 2, the front end 70*a* contacts the partition wall 61 of the nozzle tip 60 to seal between the front end 70*a* and the partition wall 61. Accordingly, the radial grooves 76 form three fourth communication paths 3*d* into which the content medium M drawn from the annular third communication path 3*c* is introduced, and the cylindrical groove 77 forms a fifth communication path 3*e* into which the content medium M drawn from the fourth communication paths 3*d* is introduced. The fifth communication path 3*e* serves as a junction space $R_4$ that communicates to the outside via the ejection orifice 60*a*. In the present embodiment, the fifth communication path 3*e* is formed in corporation with a concavity 64 formed in the partition wall 61 of the nozzle tip 60.

With reference to FIG. 1, in the present embodiment, as usual, in response to repeated pressing and return movements of the spray nozzle H, the content medium M contained in the container body 20 is sucked to the pump chamber $R_1$ and the pump chamber $R_2$ and is pressurized. Subsequently, as the upper end opening $A_1$ in the stem 41 is released by the tip portion 38$a_1$ of the plunger body 38*a*, the pressurized content medium M is pumped to the mesh ring 42 through the upper end opening $A_1$. After passing through the mesh ring 42, the content medium M keeps its high pressure.

Next, with reference to FIG. 2, the content medium M passes though the introduction path 1 to be pumped into the guiding path 2. Thus, the content medium M is introduced to the filling space $R_3$. The content medium M introduced to the filling space $R_3$ then passes through the first communication path 3*a* (the through hole 73) and the second communication path 3*b* (the long groove 74) to be introduced to the third communication path 3*c* (the annular inclined surface 75). The content medium introduced to the third communication path 3*c* is divided into two partial flows along the third communication path 3*c* and swirl around the third communication path 3*c*. At this time, the content medium M introduced to the third communication path 3*c* enters the three fourth communication paths 3*d* and is introduced to the fifth communication path 3*e* from the three fourth communication paths 3*d*. The content medium M introduced to the fourth communication path 3*d* is introduced to the fifth communication path 3*e* as a swirling flow flowing in the four communication path 3*d* as a spinning flow path and is sprayed to the outside through the ejection orifice 60*a*.

Figure 8A:
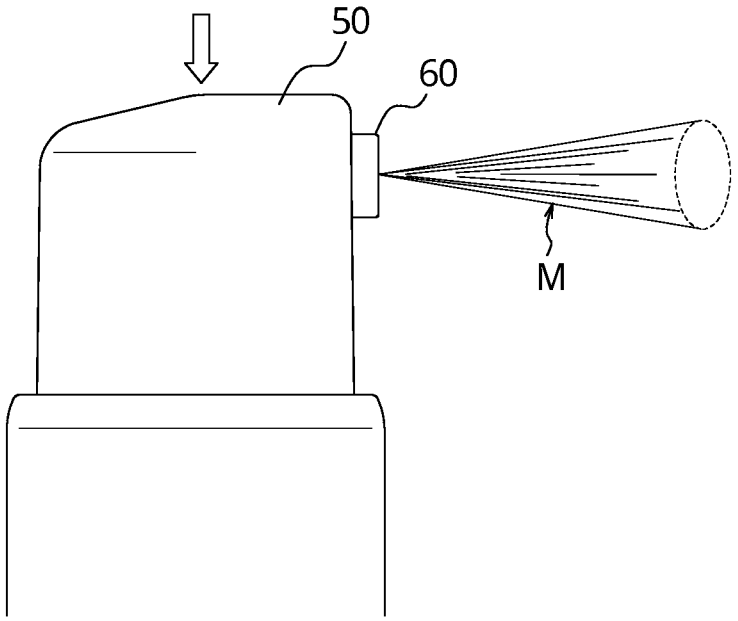
FIG. 8A is a schematic view of a state of spraying with use of the spray head according to the one embodiment.
Figure 8B:
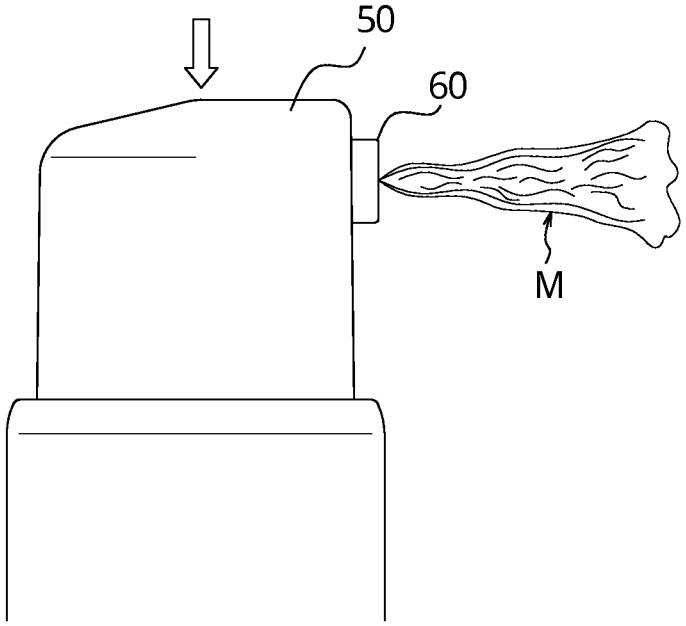
FIG. 8B is a view of a state of spraying with use of a conventional spray head.

That is to say, the communication path formed between the nozzle tip 60 and the insert member 70 includes the first communication path 3*a* (the through hole 73), the second communication path 3*b* (the long groove 74), the third communication path 3*c* (the annular inclined surface 75), the fourth communication paths 3*d* (the radial grooves 76), and the fifth communication path 3*e* (the cylindrical groove 77). As illustrated in FIG. 8A, the above configuration further stabilizes ejection patterns, which are defined by states, angles, or the like of spraying, as can be seen clearly from comparison with conventional ejection patterns illustrated in FIG. 8B.

Figure 7:
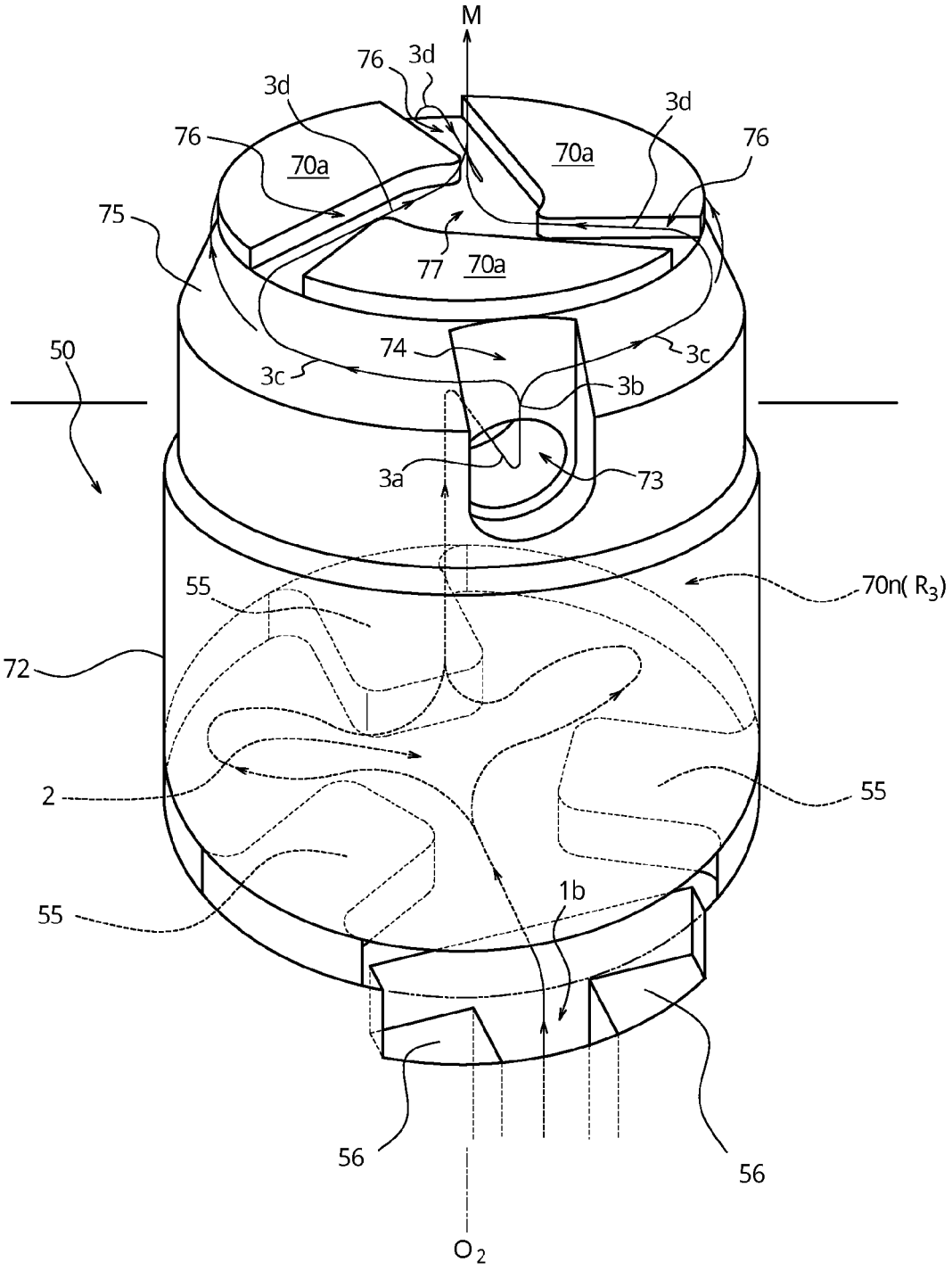
FIG. 7 is a schematic perspective view of a passage (a flow path) of a content medium passing between a nozzle tip and the insert member according to the one embodiment.

In particular, as illustrated in FIG. 7, since in the present embodiment the second communication path 3*b* is located in the position that is circumferentially offset from the fourth communication paths 3*d*, the content medium M drawn from the first communication path 3*a* is imparted with a rotational force while passing through the outer third communication path 3*c* before being introduced to the fourth communication paths 3*d*. In the fourth communication paths 3*d*, a greater rotational force is imparted to the content medium M. As a result, using the spray head H according to the present invention facilitates application of a spinning (rotational) force to the content medium M drawn from the first communication path 3*a* to achieve spray patterns that are even more improved. Thus, the present embodiment prevents the introduced content medium M from being biased to any of the fourth communication paths 3*d* before being sprayed.

In contrast, when the second communication path 3*b* is located in a position that is circumferentially aligned with the fourth communication paths 3*d*, the introduced content medium M is biased toward the fourth communication paths 3*d*. Accordingly, in the present invention, when a plurality of the first communication paths 3*a* (the through holes 73), along with the plurality of fourth communication paths 3*d* (the radial grooves 76), are formed, it is only necessary that at least one of the plurality of the first communication paths 3*a* (the through holes 73) be located in a position that is circumferentially offset from any of the plurality of fourth communication paths 3*d* (the radial grooves 76).

Figure 9A:
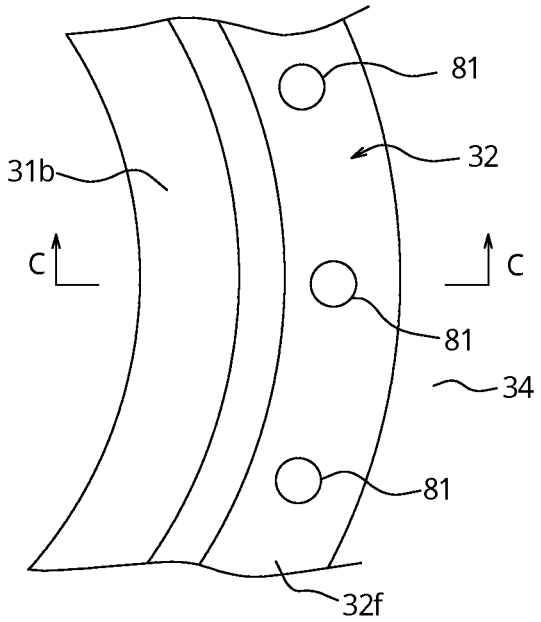
FIG. 9A is a partial bottom view of an exemplary protrusion formed in an upper end flange according to the one embodiment.
Figure 9B:
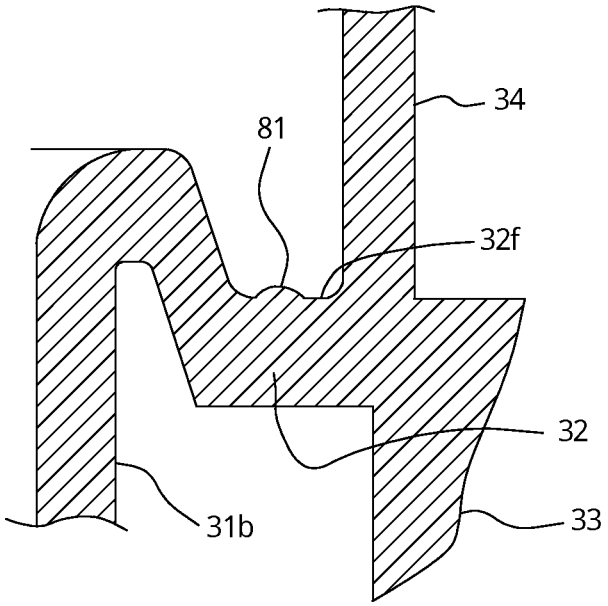
FIG. 9B is a sectional view taken along a line C-C in FIG. 9A.

Reference is now made to FIGS. 9A and 9B which illustrate, as a modified example of the above embodiment, a mechanism for reducing collision noise generated when the spray head H is pushed down. The collision noise reduction mechanism includes a protrusion 81 formed on the upper end flange 32 connecting the first cylinder 31 and the fitting tube 33 according to the above embodiment. The protrusion 81 protrudes from an upper end surface 32*f* of the upper end flange 32 toward a lower end surface 51*f* of the pressing member 50. The protrusion 81 may be arranged on a part of the upper end surface 32*f* or may be arranged at an interval about the axis line $O_1$. In the present example, a plurality of protrusions 81 are arranged at an equal interval about the axis line $O_1$.

Each protrusion 81 comes into contact with the lower end surface 51*f* of the pressing member 50 when the spray head H is pushed down. Accordingly, the protrusion 81 determines a lower limit of how far down the spray head H may be pushed down. In the present example, since the protrusion 81 is formed on the upper end flange 32, when the spray head H is pushed down, the lower end surface 51*f* of the pressing member 50 comes into partial contact with the protrusion 81 formed on the upper end flange 32. In this case, compared with a case where the lower end surface 51*f* of the pressing member 50 comes into full contact with the upper end surface 32*f*, a contact area between the spray head H and the upper end flange 32 is reduced. Accordingly, collision noise generated due to contact between the spray head H and the upper end flange 32 (the first cylinder) is effectively reduced or prevented.

Furthermore, in the present example, as illustrated in FIG. 9B, each protrusion 81 is formed in a dome shape (a semi-spherical shape). The protrusion 81 may be made of an elastic resin and may be made integrally with or separately from the upper end flange 32. In this case, when the spray head H is pushed down to bring the lower end surface 51*f* of the pressing member 50 into contact with the protrusion 81, the protrusion 81 undergoes a small degree of elastic compressive deformation. Accordingly, the collision noise is further reduced or prevented.

Moreover, the pump unit P according to the present embodiment is suited for use in an accumulator dispenser that, when the spray head H is pushed down, increases pressure in the first cylinder 31 to eject the content medium M contained in the container body 20 from the ejection orifice 60*a*. In such an accumulator dispenser, the ejection of the content medium M might cause a rapid decrease in a reaction force against the pushing-down of the spray head H, possibly resulting in an increase in a speed of contact between the lower end surface 51*f* of the pressing member 50*a* and the upper end flange 32. In this circumstance, a loud collision noise is likely to be generated. However, the dispenser according to the present example is capable of minimizing such a loud collision noise.

Figure 10A:
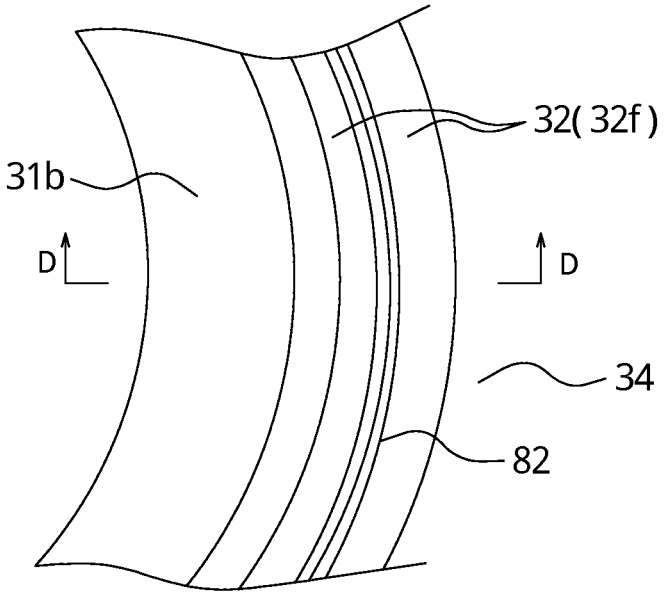
FIG. 10A is a partial bottom view of another exemplary protrusion formed in the upper end flange according to the one embodiment.
Figure 10B:
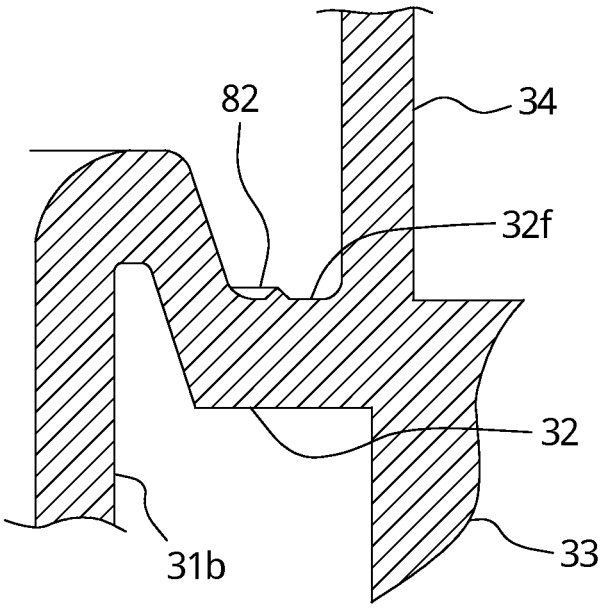
FIG. 10B is a sectional view taken along a line D-D in FIG. 10A.

FIGS. 10A and 10B illustrate another example of the collision noise reduction mechanism. The illustrated collision noise reduction mechanism includes another type of protrusion formed on the upper end flange 32. In the present example, an annular protrusion 82, extending circumferentially about the axis line $O_1$, is formed on the upper end flange 32. As illustrated in FIG. 10B, the protrusion 82 is shaped in an angle section and may be configured in the same manner as the aforementioned protrusion 81. The protrusion 82 also determines the lower limit of how far the spray head H may be pushed down and helps reduce the contact area between the spray head H and the upper end flange 32. Accordingly, with the protrusion 82 also, the collision noise is effectively reduced or prevented.

Figure 11A:
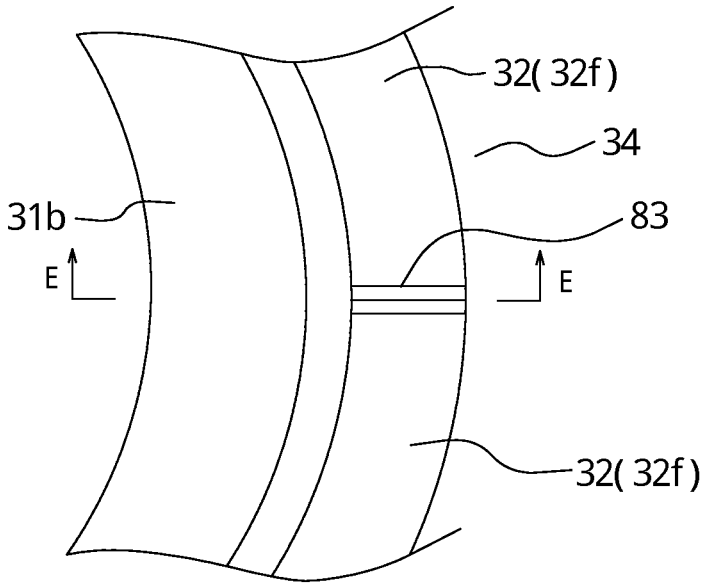
FIG. 11A is a partial bottom view of yet another exemplary protrusion formed in the upper end flange according to the one embodiment.
Figure 11B:
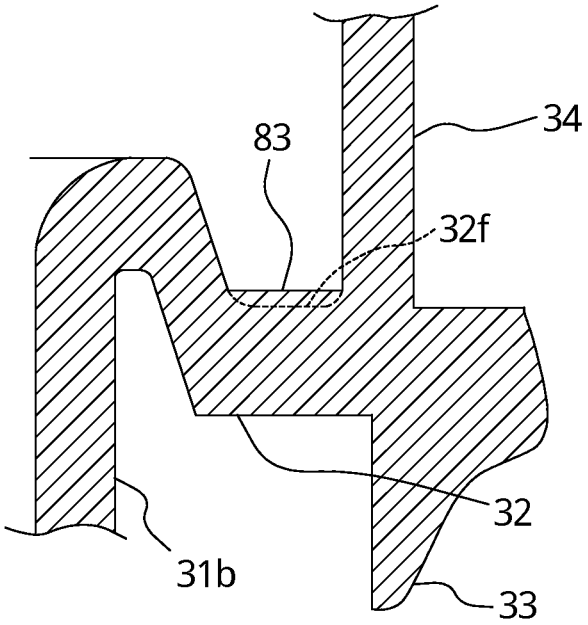
FIG. 11B is a sectional view taken along a line E-E in FIG. 11A.

FIGS. 11A and 11B illustrate yet another example of the collision noise reduction mechanism. The illustrated collision noise reduction mechanism includes yet another type of protrusion formed on the upper end flange 32. In the present example, a radially extending protrusion 83 is formed on the upper end flange 32. In the present example, as illustrated in FIG. 11A, the protrusion 83 is shaped in an angle section and is formed in a linear shape connecting the large-diameter portion 31*b* of the first cylinder 31 and the guiding tube 34. The protrusion 83 may be arranged on a part of the upper end surface 32*f* or may be arranged at an interval about the axis line $O_1$. For example, a plurality of protrusions 83 may be radially arranged at an equal interval about the axis line $O_1$. The protrusion 83 may be configured in the same manner as the aforementioned protrusion 81. The protrusion 83 also determines the lower limit of how far the spray head H may be pushed down and helps reduce the contact area between the spray head H and the upper end flange 32. Accordingly, with the protrusion 83 also, the collision noise is effectively reduced or prevented.

Figure 12A:
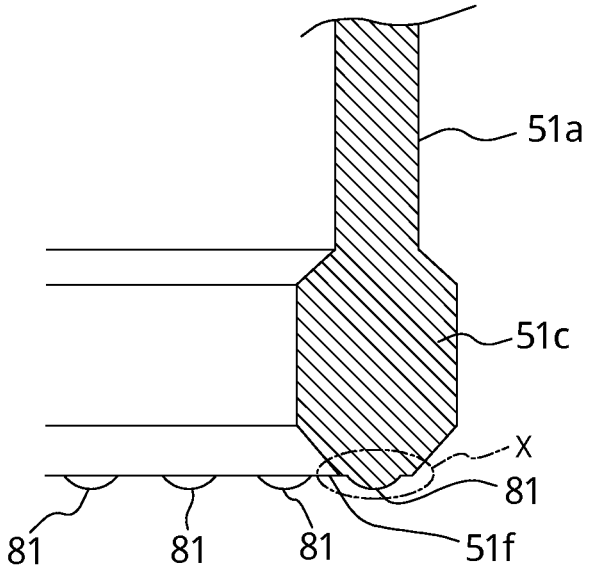
FIG. 12A is an enlarged sectional view of an exemplary protrusion formed on a lower end surface of the pressing member according to the one embodiment.
Figure 12B:
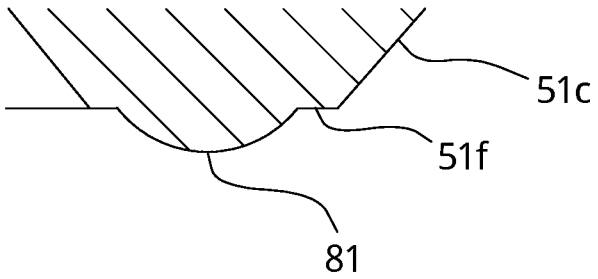
FIG. 12B is an enlarged sectional view of an area X in FIG. 12A.

FIGS. 12A and 12B illustrate the collision noise reduction mechanism formed on the side of the spray head H instead of on the side of the container body 20. In the present example, the aforementioned protrusion 81 is formed on the lower end surface 51*f* of the pressing member 50. In this case, the shape, number, and arrangement of the protrusion 81 formed on the lower end surface 51*f* of the pressing member 50 may be determined in the same manner as the case of the protrusion 81 formed on the upper end flange 32. That is to say, the protrusion 81 formed on the lower end surface 51*f* of the pressing member 50 also determines the lower limit of how far the spray head H may be pushed down and helps reduce the contact area between the spray head H and the upper end flange 32. Accordingly, with the protrusion 81 formed on the lower end surface 51*f* also, the collision noise is effectively reduced or prevented.

Figure 13A:
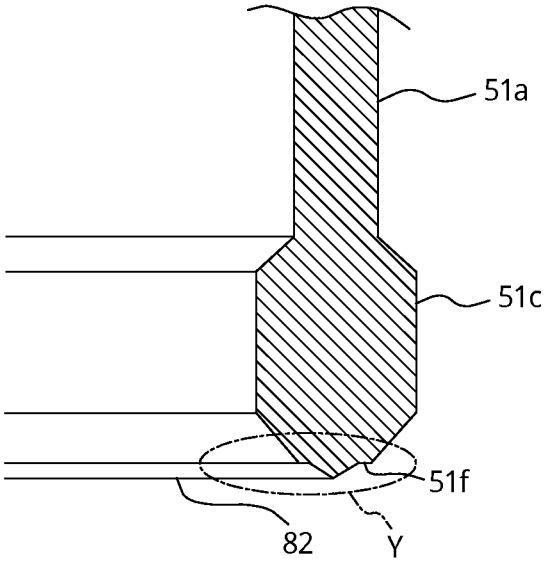
FIG. 13A is an enlarged sectional view of another exemplary protrusion formed on the lower end surface of the pressing member according to the one embodiment.
Figure 13B:
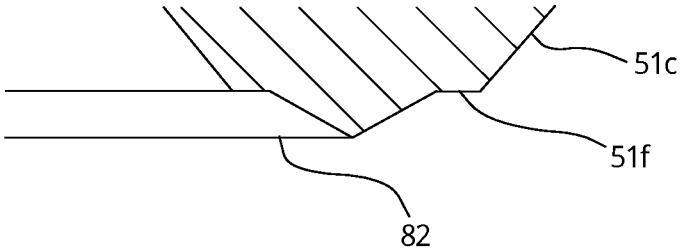
FIG. 13B is an enlarged sectional view of an area Yin FIG. 13A.

FIGS. 13A and 13B illustrate another example of the collision noise reduction mechanism formed on the side of the spray head H. In the present example, the aforementioned annular protrusion 82 is formed on the lower end surface 51*f* of the pressing member 50. In this case, the shape, number, and arrangement of the protrusion 82 formed on the lower end surface 51*f* may be determined in the same manner as the case of the protrusion 82 formed on the upper end flange 32. That is to say, the protrusion 82 formed on the lower end surface 51*f* of the pressing member 50 also determines the lower limit of how far the spray head H may be pushed down and helps reduce the contact area between the spray head H and the upper end flange 32. Accordingly, with the protrusion 82 formed on the lower end surface 51*f* also, the collision noise is effectively reduced or prevented.

The protrusions are not limited to have the dome shape and the shape with the angle section as described above, and a truncated conical shape, a truncated pyramid shape, a shape with a semi-cylindrical section, and the like may also be adopted. Furthermore, instead of the annular protrusion 82, a plurality of circumferential ridges may be formed in at least one position on the same circumference extending about the axis line $O_1$, For example, the plurality of circumferential ridges may be arranged on the same circumference at an interval, preferably at an equal interval. Moreover, the protrusion may be formed on each of the upper end flange 32 and the lower end surface 51*f* of the pressing member 50, in positions that allow these protrusions to come into contact with each other or in alternate positions that prevent these protrusions from coming into contact with each other. That is to say, the protrusion may be formed on at least one of the upper end flange 32 and the lower end surface 51*f* of the pressing member 50. The position of the protrusion is not limited to the upper end flange 32 and the lower end surface 51*f* of the pressing member 50 if only the protrusion may help reduce or prevent the collision noise when the spray head H is pushed down.

The embodiment of the present invention is described by way of example, and various changes may be made within the scope of the claims. For example, the ejection head H is not limited to the spray (atomizer) head and may dispense the content in the original form of the content, such as emulsion, or in the form of foam. Although in the above embodiment the ejection head is incorporated to the pump unit, according to the present invention, the ejection head may be configured as an individual member.

INDUSTRIAL APPLICABILITY

The present invention is applicable, for example, as a liquid ejecting device in the fields of cosmetics such as face lotion and hair liquid, medicine such as an insect repellant, and beauty and health products.

REFERENCE SIGNS LIST

1 introduction path
1*a* vertical flow path
1*b* front-rear flow path
2 guiding path
3 communication path
3*a* first communication path
3*b* second communication path
3*c* third communication path
3*d* fourth communication path
3*e* fifth communication path
10 pump bottle container
20 container body
21 mouth tubular portion
22 shoulder portion
23 trunk portion
30 pump unit
31 first cylinder
31*a* small-diameter portion
31*b* large-diameter portion
31*n* ambient air introduction hole
32 upper end flange
32*f* upper end surface of upper end flange
33 fitting tube
34 guiding tube
34*c* slip-off preventing portion
35 intake pipe
36 check valve
37 spring
38 pump plunger
38*a* plunger body
38$a_1$ tip portion of plunger body
38*b* first piston
38*c* second piston
38*d* rib
39 second cylinder
39*a* lower end tube of second cylinder
39*b* upper end tube of second cylinder
40 cylinder cap
41 stem
42 mesh ring
42*a* ring member
42*b* mesh member
50 pressing member
50*f* pressing surface
50*n* concavity
51 tubular portion
51*a* outer tubular portion
51*b* inner tubular portion
51*c* slip-off preventing portion
51*f* lower end surface of pressing member
52 circumferential wall
53 partition wall

54 inner circumferential surface of concavity
55 bump
56 stepped portion
60 nozzle tip
60*a* ejection orifice
61 partition wall
62 circumferential wall
63 sealing portion
64 concavity
70 insert member
70*a* front end
70*b* rear end
70*n* concave portion
71 partition wall
71*a* bulging portion
72 circumferential wall
73 through hole
74 long groove
75 inclined surface
76 radial groove (spin groove)
77 cylindrical groove
78 annular groove
81 protrusion
82 protrusion
83 protrusion
$A_1$ upper end opening
$A_2$ opening
$C_1$ fixing means
$C_2$ fixing means
$C_3$ fixing means
H spray head (ejection head)
$O_1$ first pump chamber
$O_2$ center of concavity
$R_1$ first pump chamber
$R_2$ second pump chamber
$R_3$ filling space
S seal member

The invention claimed is:

1. An ejection head, comprising:

a pressing member that is fitted to a stem standing from a mouth tubular portion of a container body and that is formed with an introduction path to which a content medium is introduced; a nozzle tip that is fitted to a concavity formed on a side surface of the pressing member and that is formed with an ejection orifice for the content medium pumped from the introduction path; and an insert member that is located inside the nozzle tip and that forms a communication path allowing the introduction path formed in the pressing member to communicate with the ejection orifice formed in the nozzle tip, wherein the nozzle tip includes: a partition wall that is provided with the ejection orifice; and a cylindrical circumferential wall connected to the partition wall, the insert member includes: a partition wall that is fitted to an inner side of the partition wall of the nozzle tip; a cylindrical circumferential wall connected to the partition wall of the insert member and fitted to the inner surface of the circumferential wall of the nozzle tip; a concave portion formed by the circumferential wall of the insert member and having an opening formed in a rear end of the insert member that faces to the pressing member, thereby forming a filling space to be filled with the content medium introduced from the introduction path; at least one through hole which pierces the circumferential wall of the insert member; and a long groove that is formed on an outer surface of the circumferential wall of the insert member and that extends from the at least one through hole to the nozzle tip, and the insert member has a front end facing to the nozzle tip, the front end having an outer circumferential edge formed as an annular inclined surface tapered toward a front end thereof, and the front end being formed with a bulging portion that protrudes forward of the inclined surface, the bulging portion being formed with a plurality of radial grooves and a cylindrical groove where the plurality of radial grooves joins, and at least one of the at least one through hole is located in a position that is circumferentially offset from the plurality of radial grooves.

2. The ejection head of claim 1, wherein the at least one through hole comprises a slant hole having a diameter that is increased in a direction from an inside to an outside of the insert member.

3. The ejection head of claim 1, wherein the introduction path includes an opening formed in an upper position, the opening allowing the introduction path to communicate with the filling space.

4. The ejection head of claim 1, wherein the concavity is provided with a plurality of bumps that form a plurality of radial grooves and a cylindrical groove where the plurality of radial grooves joins, and by bringing the insert member into abutment with the plurality of bumps, a guiding path allowing the introduction path to communicate with the communication path is formed.

5. The ejection head of claim 1, wherein the at least one through hole comprises a single through hole that is located in the position that is circumferentially offset from the plurality of radial grooves.

6. A container, comprising:

the ejection head of claim 1; and the container body including a pump having the stem to which the ejection head is fitted.

* * * * *